US009796110B2

(12) United States Patent
Joslyn et al.

(10) Patent No.: US 9,796,110 B2
(45) Date of Patent: Oct. 24, 2017

(54) METHOD FOR MAKING DRY CAST BLOCK WITH BURNISHED SURFACE

(75) Inventors: Mark L. Joslyn, Andover, MN (US); Kevin J. Hegyi, Rogers, MN (US)

(73) Assignee: Anchor Wall Systems, Inc., Minnetonka, MN (US)

( * ) Notice: Subject to any disclaimer, the term of this patent is extended or adjusted under 35 U.S.C. 154(b) by 1058 days.

(21) Appl. No.: 12/512,204

(22) Filed: Jul. 30, 2009
(Under 37 CFR 1.47)

(65) Prior Publication Data

US 2011/0023403 A1 Feb. 3, 2011

(51) Int. Cl.

| | |
|---|---|
| ***B28B 11/08*** | (2006.01) |
| ***B28B 11/14*** | (2006.01) |
| ***B24B 7/22*** | (2006.01) |
| ***B24B 21/04*** | (2006.01) |
| ***B28B 17/00*** | (2006.01) |
| ***E04B 2/14*** | (2006.01) |
| *E04B 2/02* | (2006.01) |

(52) U.S. Cl.
CPC ..... *B28B 17/0027* (2013.01); *B24B 7/22* (2013.01); *B24B 21/04* (2013.01); *B28B 11/0845* (2013.01); *B28B 11/14* (2013.01); *E04B 2/14* (2013.01); *E04B 2002/026* (2013.01)

(58) Field of Classification Search
CPC .... B28B 11/0845; B28B 11/14; B28B 17/027
USPC ..... 264/333
See application file for complete search history.

(56) References Cited

U.S. PATENT DOCUMENTS

| | | | | |
|---|---|---|---|---|
| 2,375,276 | A * | 5/1945 | Brown | B28B 1/52 264/280 |
| 5,167,991 | A * | 12/1992 | Lowe | 427/267 |
| 5,441,677 | A * | 8/1995 | Phillips, Sr. | 264/31 |
| 6,035,599 | A | 3/2000 | Sonnentag | |
| 6,540,501 | B1 * | 4/2003 | Bott | 425/385 |
| 6,874,494 | B2 | 4/2005 | Scherer et al. | |
| 6,994,081 | B2 * | 2/2006 | Pedersen et al. | 125/35 |
| 7,428,900 | B2 | 9/2008 | Scherer | |

(Continued)

FOREIGN PATENT DOCUMENTS

DE 3741993 A1 * 6/1989

OTHER PUBLICATIONS

European Patent Office, abstract and machine translation of Description and Claims of DE3741993A1, dated Jun. 20, 2016, Description pp. 1-3 and Drawings pp. 1 and 2.*

(Continued)

*Primary Examiner* — Matthew Daniels
*Assistant Examiner* — Patrick Butler
(74) *Attorney, Agent, or Firm* — Merchant & Gould P.C.

(57) ABSTRACT

A block has a front face with a first surface of non-planar roughness including at least 10% and not more than 90% of the area of the front face. The front face includes a second surface that is even and generally planar, with at least 10% and not more than 90% of the area of the front face. In one example, the first surface is a split face, and the second surface is a burnished split face. In another example, the first surface is a molded face, and the second surface is burnished. Methods of making a block include molding, curing, in some implementations splitting, and then burnishing. Walls can be constructed from these blocks.

11 Claims, 5 Drawing Sheets

(56) References Cited

U.S. PATENT DOCUMENTS

| | | | | |
|---|---|---|---|---|
| 2003/0047176 | A1* | 3/2003 | Benyovits | B23D 59/02<br>125/12 |
| 2006/0273492 | A1* | 12/2006 | Johnson | 264/333 |
| 2007/0289247 | A1* | 12/2007 | Hamel | 52/596 |

OTHER PUBLICATIONS

English Translation of DE 3741993 A1; Translated by USPTO Translator John Koytcheff, Aug. 23, 2016; pp. 1-11.*

* cited by examiner

METHOD FOR MAKING DRY CAST BLOCK WITH BURNISHED SURFACE

TECHNICAL FIELD

This disclosure relates to dry cast masonry blocks and methods for making them. More specifically, this disclosure relates to a block having a split face or a molded 3-dimensional textured face treated with a burnishing process and methods for making such blocks.

BACKGROUND

Concrete masonry blocks are made in automated production plants and typically are uniform in appearance. In certain applications, this is not an undesirable characteristic, but in other applications, it is a drawback where there is a demand for other aesthetic or face styles used to construct walls or other structures.

One way to make concrete masonry blocks less uniform and more natural appearing is to use a splitting process to create a rock face, or a split face, on the block. In this process, as it is commonly practiced, a large concrete work piece which has been adequately cured after molding is split to form two blocks. The resulting faces of the resulting two blocks along the plane of splitting are textured and irregular, so as to appear as more naturally occurring rock faces. This process of splitting a work piece into two masonry blocks to create a rock-like appearance on the exposed faces of the blocks is shown in U.S. Pat. No. 1,534,353, incorporated herein by reference, which discloses the manual splitting of blocks using a hammer and chisel.

Automated equipment to split blocks is well-known and can include various types of powered splitting blades. A splitting blade in this application is typically a substantial steel plate that is tapered to a relatively narrow knife edge. The blades are typically arranged so that the knife edges will engage the top and bottom and side surfaces of the work piece.

These machines are useful for the high speed processing of blocks. They produce a split face finish on the blocks. No two faces resulting from this process are identical, so the blocks are more natural in appearance than standard, non-split blocks.

Other ways of treating masonry blocks in a manner to result in a more decorative, and less machine-generated look, is by putting the block through a burnishing process. In a burnishing process, the target surface is subject to multiple grinders, in which a belt sander will grind, polish, and expose aggregate in the treated face of the block. The resulting block face has a very formal, polished appearance, with visible aggregate. However, in some application, this appearance is more formal and uniform than is desired. In contrast, a block with a resulting split face has the appearance of being very informal. A split face also can have sharp protrusions extending from the exposed face, and if used in an environment with close contact to people, it can catch clothing. There is a need for a masonry block that is convenient to manufacture that is does not have the appearance of the highly formal surface of burnishing and which does not have the drawbacks of a split face.

SUMMARY OF THE DISCLOSURE

In one aspect, this disclosure concerns a dry cast block including a block body having a front face. The front face includes a first surface of non-planar roughness comprising at least 10% and not more than 90% of the area of the front face. The front face includes a second surface that is generally planar, comprising at least 10% and not more than 90% of the area of the front face. The first surface has regions recessed in the front face relative to the entire second surface, and the entire first surface has no portion that projects beyond any portion of the second surface.

In one example implementation, the first surface is a non-burnished split face. In one example, the second surface is a burnished split face. In another example, the first surface is a non-burnished molded 3-dimensional textured surface having a maximum relief of 0.5 inch, while the second surface is a burnished surface.

In another aspect, a method of making a block is provided. The method includes molding a block body from dry cast concrete. Next, there is a step of curing the block body. Next, the block body is split to result in at least a single block having a split face. Next, there is the step of burnishing at least 10% and no more than 90% of the area of the split face of the single block.

In one example, the step of molding includes molding a block body, and the step of splitting includes splitting the twin block body to result in two individual blocks, each of the individual blocks having a split face. This step may be followed by a step of burnishing at least 10% and no more than 90% of the area of the split face of each of the individual blocks.

In another aspect, a method of making a block includes molding a block from dry cast concrete, including molding a three-dimensional configuration in a front face, the three-dimensional configuration having a maximum relief of at least 0.5 inch. Next, the block is cured. Next, there is a step of burnishing at least 10% and no more than 90% of the area of the front face of the block.

These and various other advantages and features are pointed out with particularity in the claims. For a better understanding, reference should be made to the drawings and to the accompanying description.

DETAILED DESCRIPTION

Figure 1:
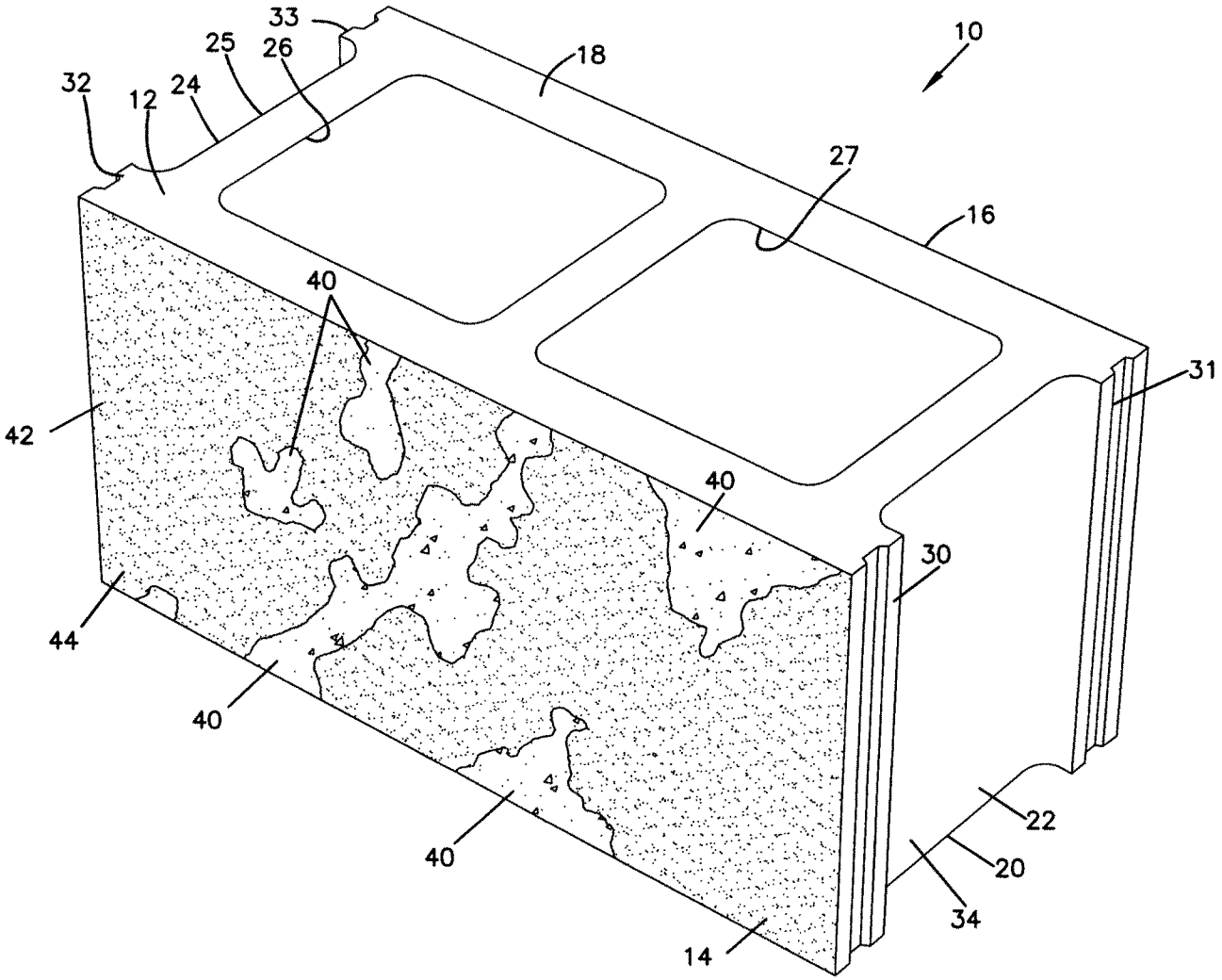
FIG. 1 is a perspective view of one example embodiment of a dry cast block, made in accordance with principles of this disclosure.

FIG. 1 illustrates a dry cast block in general 10 of the invention. The block 10, in the embodiments shown, is a masonry block that is used to construct a wall or other rigid structure. In other embodiments, the block can be a retaining wall block used for retaining walls, other blocks used in landscaping applications, or blocks used for veneers. The block 10 is preferably made from a dry cast concrete mixture, as opposed to wet cast. A dry cast concrete mixture generally is made up of cementitious material, sand, coarse aggregates, colorants, and water. Cementitious materials may include cement, fly ash, slag, and silica fume, and the methods of properly selecting or combining these constituents are known to those of skill in the art.

In the embodiments shown in FIG. 1, the block 10 includes a block body 12 with a front face 14. As used herein, the term "front face" does not necessarily means that the face of the block body 12 must be pointing toward a front direction; rather, it is meant to be the at least one of the faces that is visible after the block 14 has been arranged in a wall or other final structure. As shown in FIG. 1, the front face 14 is shown facing a forward. Of course, if the block 10 were rotated in FIG. 1 such that the front face 14 were pointing upwardly, and that was the face that was visible after being arranged in a wall, the "front face" would still mean that visible face, even though that face was not necessarily oriented in a forward direction.

In this embodiment, the block body 12 is shown as also including a rear face 16 that is opposite of the front face 14. Opposite top and bottom faces 18, 20 extend between the front face 14 and rear face 16. Opposite first and second side faces 22, 24 extend between the top face 18 and the bottom face 20 and the front face 14 and rear face 16. In this embodiment, the top face 18 and bottom face 20 are generally parallel to each other. The rear face 16 is generally flat and perpendicular to the top face 18 and bottom face 20. With the exception of the irregularities to be described further below in the front face 14, the rear face 16 and the front face 14 are generally parallel.

Also illustrated in the example embodiment of FIG. 1, the block body 12 includes a pair of cores 26, 27 extending through the top and bottom faces 18, 20. The cores 26, 27 include an open volume of space that is formed during the process of molding the block 10. The cores 26, 27 are formed generally to result in a lighter block 10. Of course, in other embodiments, the block 10 can be solid without cores.

In the example embodiment of FIG. 1, the block 10 has a pair of ridges 30, 31 extending along the first side face 22 completely between the top face 18 and bottom face 20. Similarly, there is a pair of ridges 32, 33 along the second side face 24. Between each of the ridges 30, 31 and ridges 32, 33 is a recessed or inset region 34, 35. The insets 34, 35 are recessed relative to the respective ridges 30, 31 or 32, 33 which border them. In other embodiments of the block 10, the side faces 22, 24 can be generally flat, or can have other insets or other structural features.

Still in reference to FIG. 1, and in accordance with principles of this disclosure, the block front face 14 includes at least a first surface 40 and a second surface 42 of distinctly different appearance from each other. While some embodiments may have additional distinctly appearing surfaces, in the preferred embodiment, there are no more than two distinctly appearing surfaces. It is contemplated that if there are additional distinctly appearing surfaces, the surfaces are minor in the amount of area of the front face 14 they take up, such as under 10%.

In the illustrated embodiment, the first surface 40 is a non-planar rough surface. By "non-planar," it is meant that the first surface 40 does not have a continuity to it that would result in a single plane. By "rough," it is meant that there is irregularity to the surface, such that it does not feel nor appear to be smooth, but rather, can have the appearance of unfinished, jagged, or rock-like, such as the appearance resulting from a split face, or such as the appearance resulting from a molded 3-dimensional texture with a maximum relief of at least 0.5 inch. In preferred embodiments, the first surface 40 comprises at least 10% and not more than 90% of the area of the front face 14. The term "area," as used herein means the two dimensional area of the front face 14 projected onto a plane parallel to the generally planar second surface 42 of the front face.

In some embodiments, the first surface 40 comprises at least 25% and not more than 75% of the area of the front face 14. For example, the first surface 40 can comprise at least 40% and not more than 60% of the area of the front face 14. In preferred embodiments, the first surface 40 comprises about 50% of the area of the front face 14.

The second surface 42 has an appearance that is distinctly different than the first surface 40. The second surface 42 is a generally planar surface. By the term "generally planar surface," it is meant a surface that is non-rough in appearance and has generally a smooth feel to it, as compared to the first surface 40. It forms a surface that is generally flat and in a plane, although there can be minor surface roughness to it. In the embodiments shown in FIG. 1, the second surface 42 comprises the area that is not occupied by the first surface 40. In general, the second surface 42 will comprise at least 10% and not more than 90% of the area of the front face 14. In one example embodiment, the second surface 42 has the appearance that results after a surface has been ground, polished, sanded, or burnished.

In preferred embodiments, the second surface 42 comprises at least 25% and not more than 75% of the area of the front face 14. For example, the second surface 42 can include at least 40% and more than 60% of the area of the front face 14. Preferably, the second surface 42 includes about 50% of the area of the front face 14. In many preferred implementations, the first surface 40 will comprise about 50% and the second surface 42 will comprise the remaining amount (i.e. about 50%) of the area of the front face 14. This results in a block 10 having front face 14 that is midway between an informal appearance, such as split face or textured molded face, at the first surface 40 and a formal appearance, such as burnished, at the second surface 42.

In one preferred embodiment, the second surface 42 is a burnished split face 44. By the term "burnished split face," it is meant the surface that results following a splitting process followed by contact with a grinder or sander in a burnishing process. A burnished split face 44 has the appearance of a generally even, planar surface that can appear polished and show the appearance of aggregate. In another preferred embodiment, the second surface 42 is a burnished molded face, which is the surface that results following molding a 3-dimensional textured face followed by burnishing that 3-dimensional textured face. The 3-dimensional textured face of the block can be molded according to the process described in U.S. Pat. No. 7,208,112, incorporated herein by reference. In some embodiments, the 3-dimensional textured face will have a maximum relief of at least about 0.5 inches.

In general, the first surface 40 has regions recessed in the front face 14 relative to the entire second surface 42, with no portion of the first surface 40 projecting beyond any portion of the entire second surface 42. Preferably, there will be a maximum relief between the second surface 42 and the first surface 40 of no more than 0.5 inch. In one embodiment, the resulting front face 14 with the first surface 40 and second surface 42 has the appearance of rough pockets (formed by the splitting process or 3-dimensional molding process and comprising the first surface 40), along with generally even, planar surfaces that can appear polished and show the appearance of aggregate (formed by the burnished second surface 42).

Figure 2:
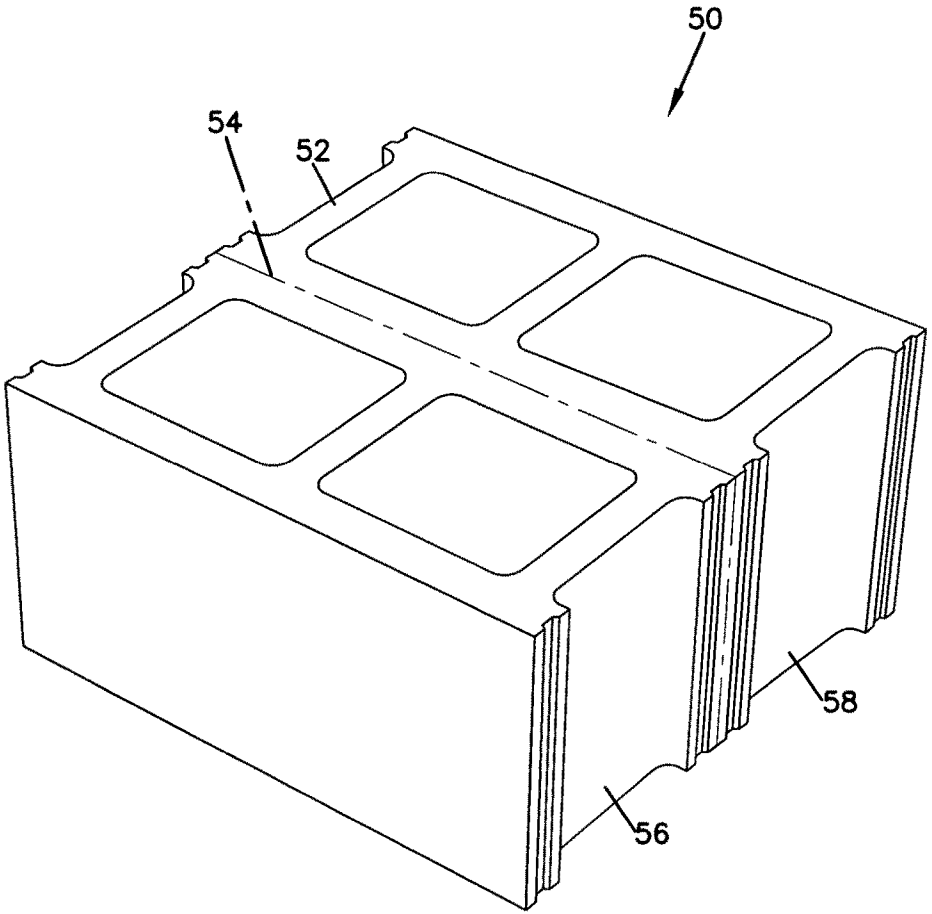
FIG. 2 is a perspective view of a pre-split block body after molding and before splitting and burnishing.
Figure 3:
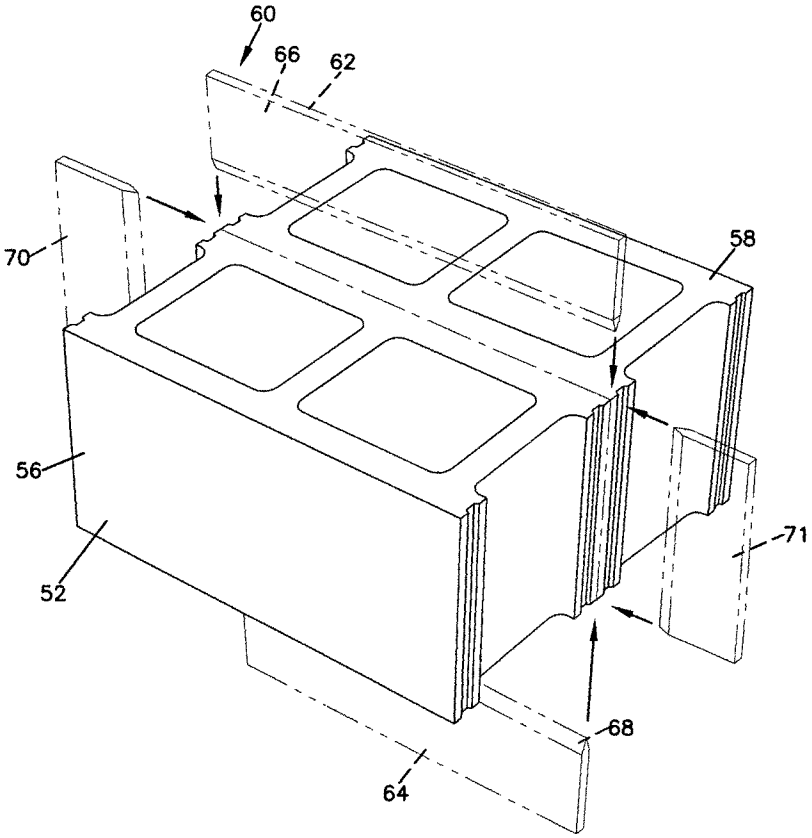
FIG. 3 is a schematic perspective view of a block splitting process used to split the block body of FIG. 2 to result in two individual blocks having a split face.
Figure 4:
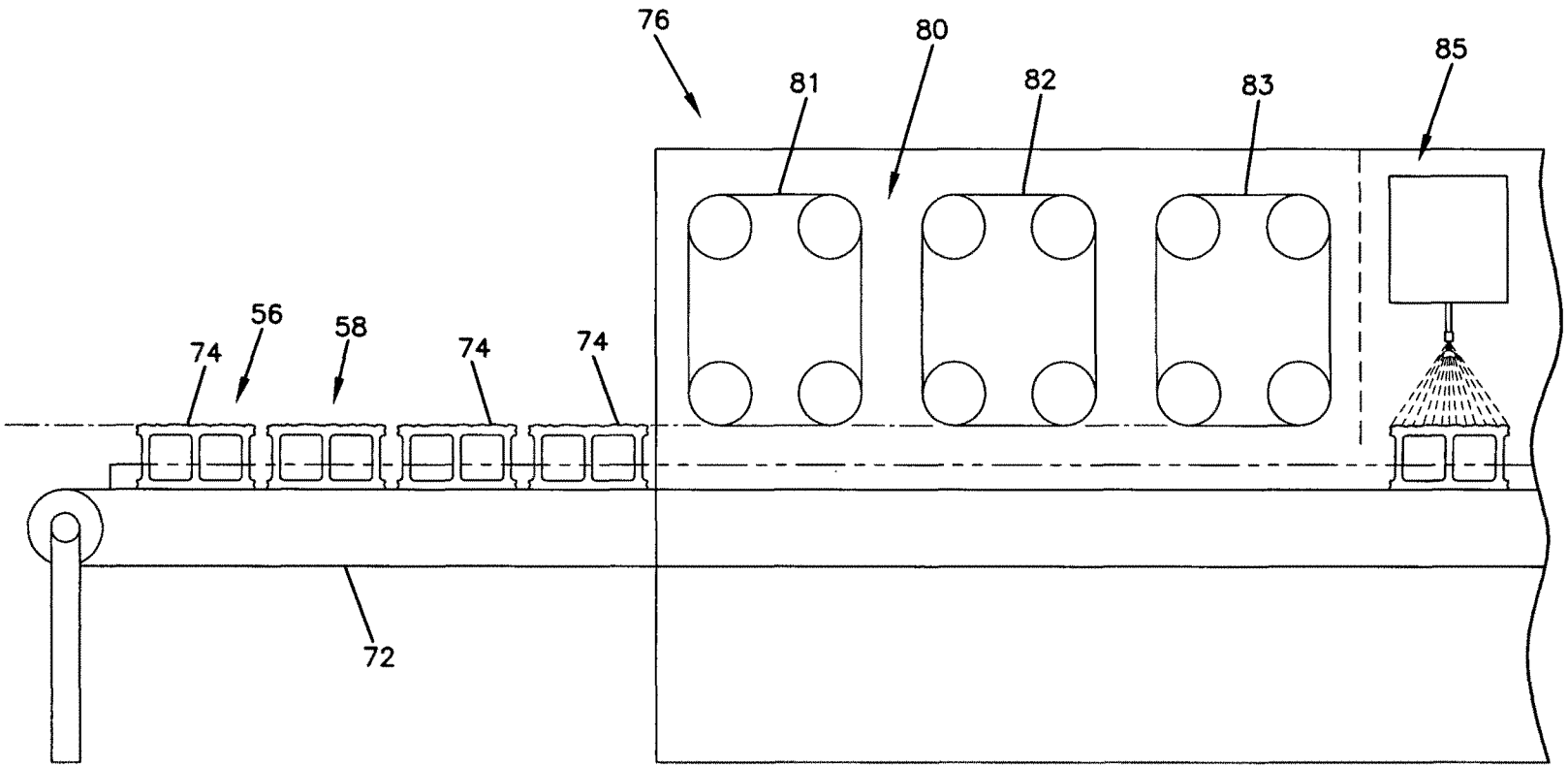
FIG. 4 is a schematic side elevational view of individual blocks, after splitting, going through a burnishing process to result in the block of FIG. 1.

In reference now to FIGS. 2-4, one process for making the block 10 is illustrated. FIG. 2 shows a molded block body 50 after it has been de-molded and before it has been split. The body block 50 is made by depositing dry cast concrete into an appropriately shaped mold, compressing the dry cast concrete in the mold, de-molding the block body 50, and then allowing the block body 50 to cure. Often, the block body 50 will be stripped from a bottomless mold by way of a stripper shoe and pushed onto a pallet. In FIG. 2, it can be seen how the block body 50 is embodied as a twin block, which includes a pair of identical blocks that are molded together, forming a work piece 52 to be split. After splitting, the block body 50 will result in two individual blocks, with each block having a split face. It should be understood that in other embodiments, the work piece 52 can be a type of molded construction, which after the splitting process will result in only a single block having a split face, with the remaining material as scrap, or something other than a block. Further, in other embodiments, the work piece 52 can be a molded construction that, after splitting, results in a two differently shaped blocks, each having a split face.

In FIG. 2, it can be seen how the work piece 52 is shown with a phantom line forming a splitting plane 54. The block body 50 will be split into a first block 56 and a second block 58 along the splitting plane 54.

In a method of making the block 10, after the block body 50 is molded and cured, the block body 50 is split to result in two blocks 56 and 58 having a split face 74 (FIG. 4). A split face is a face that has a non-planar roughness and is rock-like in appearance. The split face 74 would be one type of surface that would constitute the first surface 40 of the block 10.

FIG. 3 illustrates, schematically, one example of a splitting process. In FIG. 3, a block splitter assembly is schematically depicted at 60. In this embodiment, the block splitter 60 includes opposed first and second splitting blade assemblies 62, 64. The first splitting blade assembly 62 is positioned at the top of the block splitter 60 and includes a splitting blade 66. The second splitting blade 64 is at the bottom of the block splitter assembly 60 and includes a blade 68. In this embodiment, there are also lateral splitting blades 70, 71 that engage the work piece 52 along opposing sides of the work piece 52, in a respective planes perpendicular to the top and bottom of the work piece 52.

After the step of splitting to result in at least a single block having a split face, the split face 74 of the block is subject to a burnishing process, in which at least 10% and no more than 90% of the area of the split face of the block is burnished. One exemplary implementation of this step is illustrated in FIG. 4. After the block body 50 is split into individual blocks 56 and 58, the blocks are oriented on a conveyor 72 in a manner such that the split face 74 is facing in a direction so that it will be subject to a belt grinder for burnishing. In the example shown in FIG. 4, the split face 74 is facing upwardly.

A burnishing machine is shown schematically at 76 and includes a burnisher 78 in the form of a belt grinder arrangement 80. In this embodiment, the belt grinder arrangement 80 includes a plurality of belt grinders 81. As shown in FIG. 4, there are 3 sequential belt grinders 81. The belt grinders 81 can have a variety of grit sizes, depending upon the hardness of the block, the strength of the block, the desired amount and appearance of burnishing, and other structural or aesthetic features. In typical example applications, the belt grinder 81 has a grit size of 20-100.

In FIG. 4, the conveyor 72 moves each of blocks 56, 58 into the burnishing machine 76, where the belt grinder arrangement 80 will make contact with the split face 74, by sequentially moving from grinder 81 to 82 to 83. This contact will result in burnishing or planing at least 10% and no greater than 90% of the area of the split face 74 to result in the second surface 42. Such a result is desirable in that a split face 74 will often have sharp peaks that can catch clothing or human skin, and by subjecting the split face 74 to the burnishing process, the areas of the split face 74 that project outwardly the most are planed, smoothed, ground, or burnished off to have a generally planar appearance. The result is also that there is no portion of the split face 74 that projects or extends further outwardly than any portion of the burnished split face 44. The burnished split face 44 is attractive, in that it exposes the appearance of some of the aggregate.

In preferred embodiments, the step of burnishing includes burnishing at least 25% and no more than 75% of the area of the split face 74. For example, the step of burnishing includes burnishing at least 40% and no more than 60% of the area of the split face 74. Preferably, the step of burnishing will include burnishing about 50% of the area of the split face 74, which will result in about 50% of a burnished split face 44 and 50% of a non-planar split face 40.

In general, the conveyor 72 will move at a speed that is appropriate for the amount of time desirable to expose it to the grinder 80 during burnishing. In one example, the conveyor 72 moves at a speed of at least 30 feet per minute.

The resulting block 10, after burnishing, will include the first surface 40 of non-planar roughness and second surface 42 having an even, generally planar surface, and in particular, a burnished split face. After burnishing, the resulting block 10 can be treated in a surface-enhancing sealer station 85. In FIG. 4, this is shown as occurring in-line, after the last belt grinder 83. The block 10 can be sprayed in the sealer station 85 with a sealer, such as an acrylic sealer.

Figure 5:
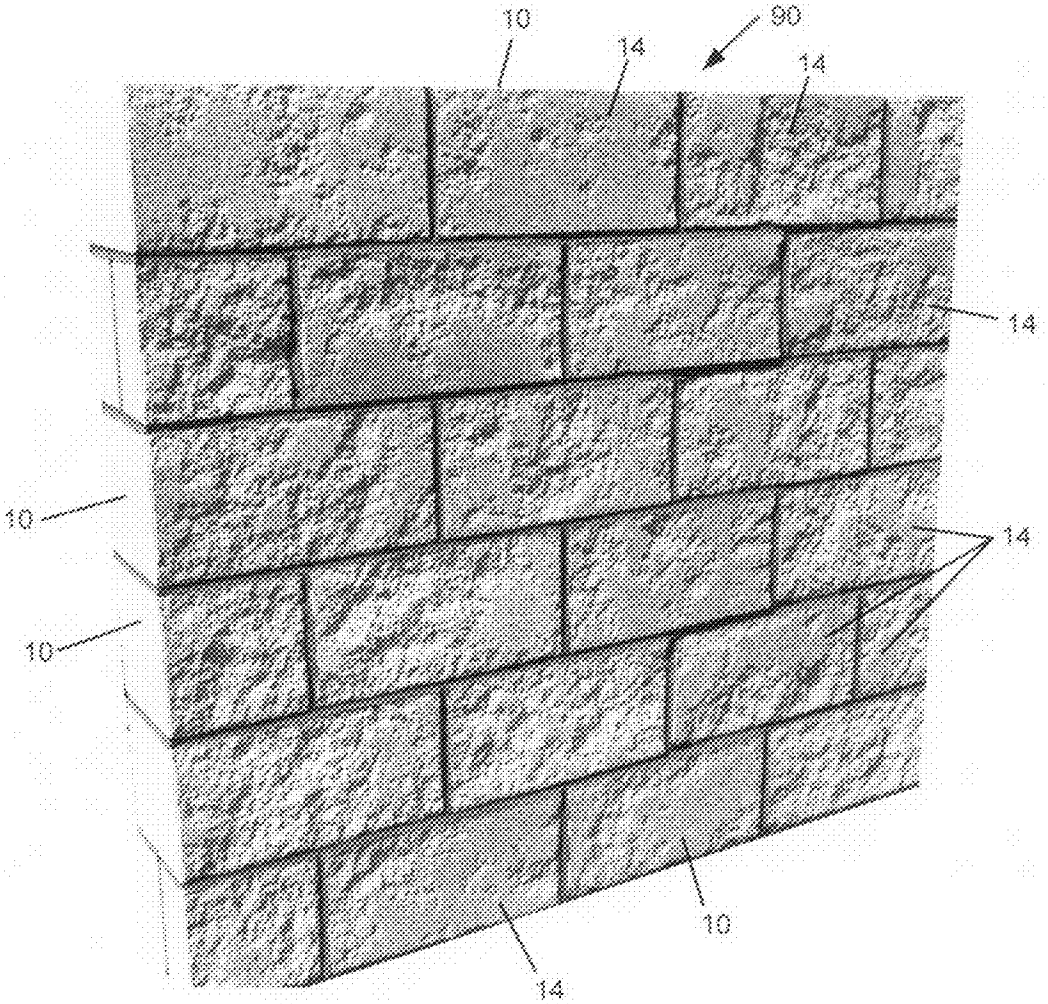
FIG. 5 is a schematic front view of a wall constructed from blocks made according to the process of FIGS. 2-4.

This resulting block 10 can then be used to construct a wall 90 as depicted in FIG. 5. Structures other than walls can be constructed, with the front face 14 being at least one of the faces that is exposed for viewing. In FIG. 5, the wall 90 is constructed from a plurality of the blocks 10. In preferred embodiments, the wall 90 will have an overall area of front faces 14 (all of the areas of the front faces 14 added together) in which at least 40% and no greater than 60% will be a split face and at least 40% and no greater than 60% will be burnished. Preferably, the wall 90 will have an overall area of front faces 14 with about 50% split face and about 50% burnished.

In another embodiment of making the block 10, the block is molded according to the process described in U.S. Pat. No. 7,208,112, incorporated herein by reference. In this method, the block is molded with the front face 14 oriented upwardly in the mold. The stripper shoe includes a molded 3-dimensional pattern or texture, with a maximum relief of at least 0.5 inches. To demold the block, the stripper shoe having the 3-dimensional pattern or texture presses against the front face 14 (which is facing upwardly and opposed to the stripper shoe). Engagement between the stripper shoe and the front face 14 results in molding a 3-dimensional pattern or texture in the front face 14, which has a maximum relief of at least 0.5 inch. The resulting block is cured, and after curing, the block is burnished, as described above with respect to FIG. 4. The block having the molded 3-dimensional front face is conveyed through the burnishing machine 76, where in the embodiment shown, the molded 3-dimensional front face is burnished with 3 sequential grinders 81, 82, 83. This results in burnishing or planing at least 10% and no greater than 90% of the area of the molded 3-dimensional face. In other embodiments, at least 25% and no greater than 75%, for example at least 40% and no greater than 60% will be planed or burnished. In preferred embodiments, about 50% of the area of the molded 3-dimensional face is burnished. After burnishing, the resulting block can be treated in the sealer station 85.

The above description provides a description of example principles and embodiments. Many embodiments can be made according to these principles.

What is claimed is:

1. A method of making a block, the method comprising:

molding a block body from dry cast concrete;

curing the block body;

splitting the block body to result in at least a single block having a split face; and burnishing at least 10% and no more than 90% of the area of the split face of the single block to result in a face having a generally planar burnished surface and a rough non-burnished surface; the non-burnished surface being recessed relative to the burnished surface.

2. The method of claim 1 wherein the step of burnishing includes using a grinder arrangement having at least one grinder belt with a grit size of 20-100 on at least 25% and no more than 75% of the area of the split face.

3. The method of claim 1 wherein the step of burnishing includes burnishing at least 40% and no more than 60% of the area of the split face of the single block.

4. The method of claim 1 wherein the step of burnishing includes burnishing the split face to result in a face having a burnished surface and non-burnished surface; a maximum relief between the burnished surface and the non-burnished surface being no more than 0.5 inch.

5. The method of claim 1 wherein:

the step of splitting includes splitting the block body to result in two individual blocks, each of the individual blocks having a split face.

6. The method of claim 5 wherein the step of burnishing includes burnishing at least 25% and no more than 75% of the split face of each of the individual blocks.

7. The method of claim 5 wherein the step of molding includes molding a block body having generally parallel top and bottom surfaces.

8. The method of claim 1 further comprising:

before the step of burnishing, orienting the single block on a conveyor; and during the step of burnishing, moving the block with the conveyor and burnishing the split face with a plurality of grinders.

9. The method of claim 8 wherein the step of burnishing the split face with a plurality of grinders includes burnishing the split face with three sequential belt grinders.

10. The method of claim 8 wherein the step of moving the block with the conveyor includes moving the conveyor at a speed of at least 30 feet per minute.

11. The method of claim 1 further comprising:

after the step of burnishing, spraying the block with a sealer.

* * * * *